US007210965B1

(12) United States Patent
Zhong et al.

(10) Patent No.: US 7,210,965 B1
(45) Date of Patent: May 1, 2007

(54) CABLE CONNECTOR ASSEMBLY

(75) Inventors: Ji-Ping Zhong, Tu-Cheng (TW); Hong-Shui Wu, Tu-Cheng (TW)

(73) Assignee: Cheng Uei Precision Co., Ltd., Taipei Hsien (TW)

( * ) Notice: Subject to any disclaimer, the term of this patent is extended or adjusted under 35 U.S.C. 154(b) by 0 days.

(21) Appl. No.: 11/405,559

(22) Filed: Apr. 18, 2006

(51) Int. Cl.
*H01R 9/03* (2006.01)

(52) U.S. Cl. ..... 439/610; 439/610

(58) Field of Classification Search ..... 439/607, 439/610

See application file for complete search history.

(56) References Cited

U.S. PATENT DOCUMENTS 3,413,594 A * 11/1968 Fernald et al. ..... 439/637
4,744,769 A * 5/1988 Grabbe et al. ..... 439/284
4,781,623 A * 11/1988 Philippson et al. ..... 439/670
4,906,208 A * 3/1990 Nakamura et al. ..... 439/607
5,797,771 A * 8/1998 Garside ..... 439/610
6,257,914 B1 * 7/2001 Comerci et al. ..... 439/357
6,447,311 B1 * 9/2002 Hu et al. ..... 439/108

* cited by examiner

*Primary Examiner*—James R. Harvey
*Assistant Examiner*—Travis Chambers
(74) *Attorney, Agent, or Firm*—Birch Stewart Kolasch & Birch, LLP

(57) ABSTRACT

A cable connector assembly includes an electrical connector having an insulative housing, a plurality of contacts received in the insulative housing and shelters covering the outer surface of the insulative housing, a cable connecting to the contacts, an outer cover having a rear surface covering the electrical connector and the inner cover has a front surface. The electrical connector has a plurality of front surfaces at a front portion thereof and a rear surface at a rear end thereof. The front surface of the inner cover leans against the front surfaces of the electrical connector and the rear surface of the outer cover leans against the rear surface of the electrical connector. A plurality of wedges are formed on the inner surface of the outer cover and a plurality of grooves corresponding to the wedges are formed on said inner cover. The wedges are mated with said grooves respectively.

9 Claims, 6 Drawing Sheets

CABLE CONNECTOR ASSEMBLY

BACKGROUND OF THE INVENTION

1. Field of the Invention

The present invention generally relates to a cable connector assembly, and more particular to a cable connector assembly assembled securely and tightly.

2. The Related Art

At present, a cable connector assembly includes an electrical connector, a cable and an outer cover. The electrical connector has an insulative housing, a plurality of terminals received in the insulative housing and a shield covering the outer surface of the insulative housing. The cable is connected with an end portion of the terminals to provide electrical connection. An inner cover covers the connection portion of the cable and the terminals. The outer cover covers the outside of the inner cover and the shield of the electrical connector. Therefore the electrical connector, the cable and the outer cover are assembled as a whole to form the cable connector assembly.

It can be seen that the inner cover and the outer cover don't have buckling mechanisms. When the cable connector assembly is used to insert into a mating connector repeatedly, the inner cover and the outer cover are liable to loosen therebetween. Therefore, the cable connector assembly is not assembled securely and tightly.

SUMMARY OF THE INVENTION

An object of the present invention is to provide a cable connector assembly which comprises an electrical connector including an insulative housing, a plurality of contacts received in the insulative housing, and at least one shelter covering the outer surface of the insulative housing, a cable electrically connecting to the contacts, an outer cover having a rear surface, an opening disposed on the rear surface, and an inner cover embedded in the outer cover and covering the electrical connector. The cable passes through the outer cover. The outer cover covers the electrical connector. The electrical connector has a plurality of front surfaces at a front portion thereof and a rear surface at a rear end thereof. The front surface of the inner cover leans against the front surfaces of the electrical connector and the rear surface of the outer cover leans against the rear surface of the electrical connector. A plurality of wedges are formed on the inner surface of the outer cover. A plurality of grooves corresponding to the wedges are formed on said inner cover, so that, the wedges are mated with said grooves respectively.

It can be seen that the inner cover is mated with the outer cover by the wedges of the outer cover and the grooves of the inner cover. Therefore, the cable connector assembly is assembled securely and tightly.

Other objects, novel features and advantages of the present invention will become more apparent from the following detailed description of a preferred embodiment thereof when taken in conjunction with the accompanying drawings.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENT

In order to illustrate the present invention particularly, including technology, structure traits, aims and efficiency, a detailed explanation of a preferred embodiment of the present invention will be given thereinafter, with reference to the annexed drawings, for better understanding thereof to those skilled in the art.

Figure 1:
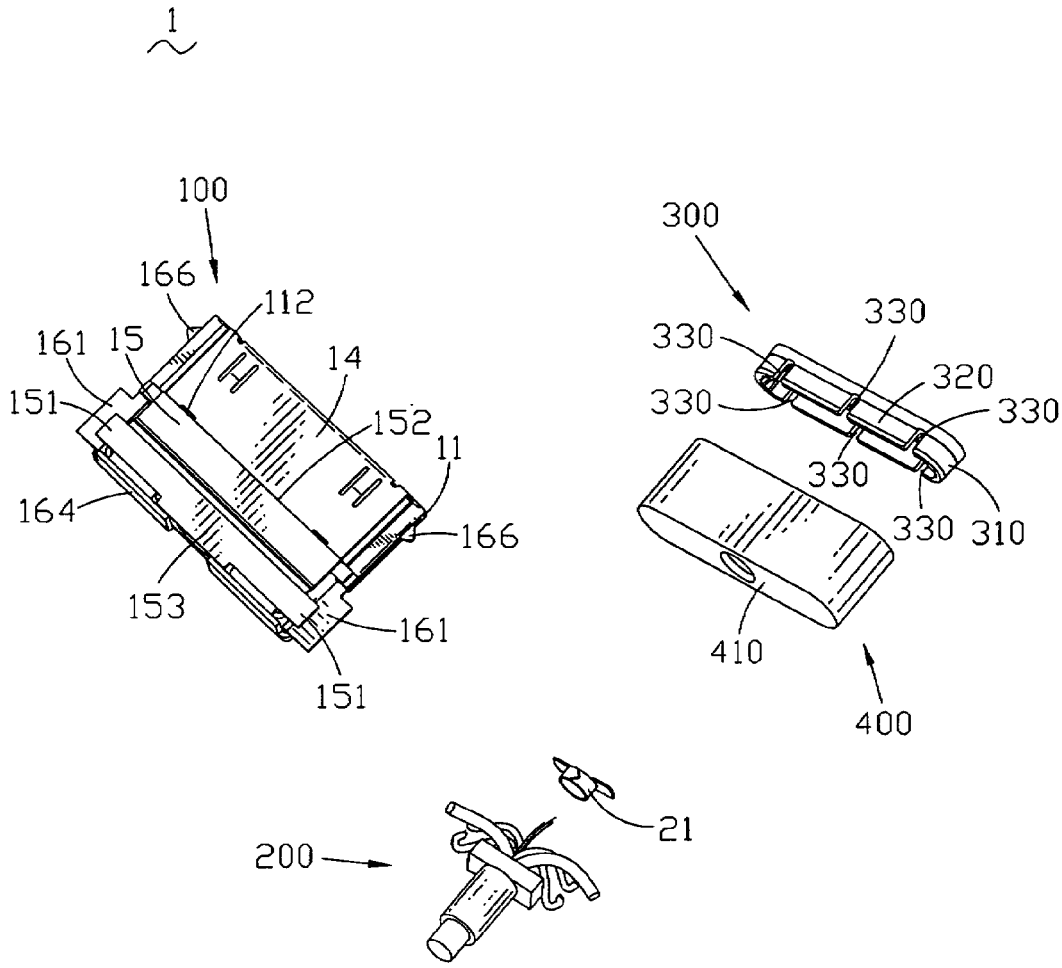
FIG. 1 is an exploded perspective view of a cable connector assembly in accordance with the present invention.

Please refer to FIG. 1, a cable connector assembly 1 of this invention comprises an electrical connector 100, a cable 200, an inner cover 300 and an outer cover 400 covering the outer portion of the electrical connector 100 and the cable 200. The inner cover 300 is received in one end of the outer cover 400 and covers the electrical connector 100.

Figure 2:
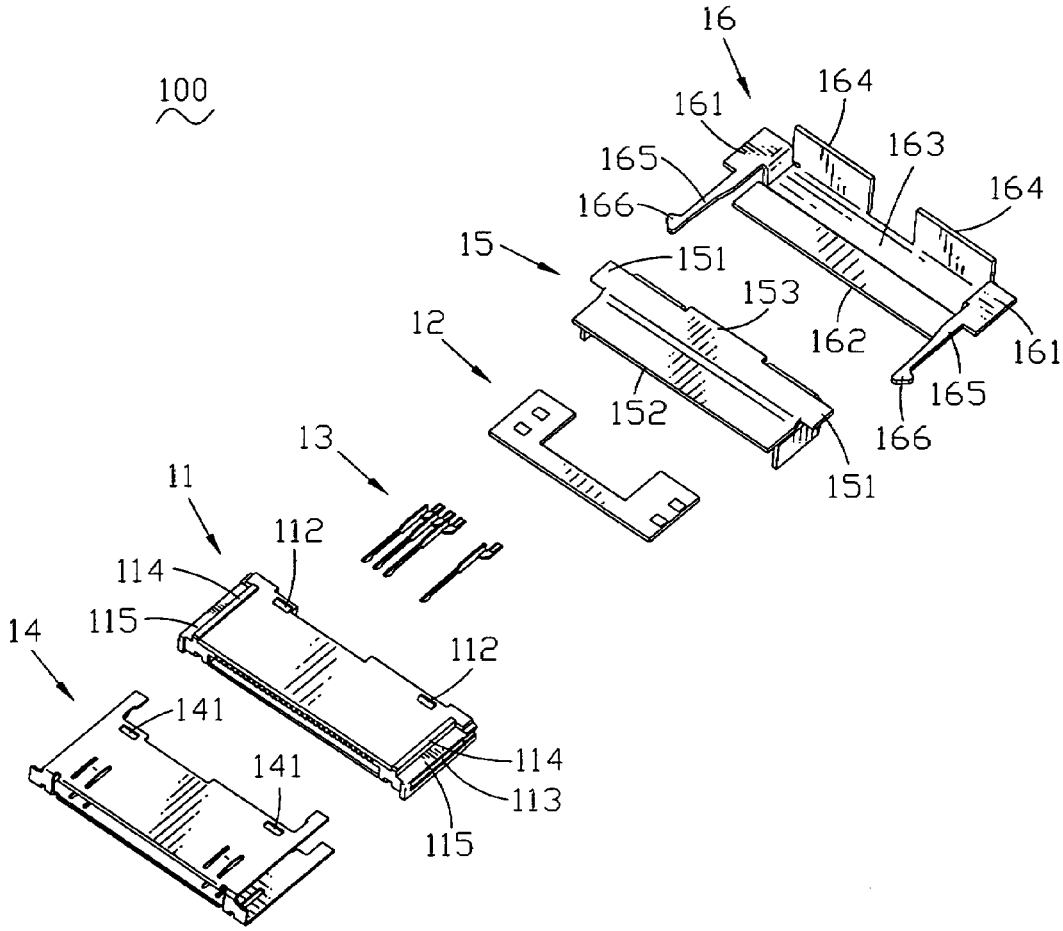
FIG. 2 is an exploded perspective view of the electrical connector of the cable connector assembly.

Referring to FIG. 2, the electrical connector 100 includes an insulative housing 11, a printed circuit board 12 and a plurality of contacts 13 connecting the insulative housing 11 and the printed circuit board 12 electrically. A front shelter 14 encloses the front portion of the insulative housing 11. An upper shelter 15 and a lower shelter 16 enclose the rear portion of the insulative housing 11, the printed circuit board 12 and the contacts 13.

Please further refer to FIG. 2, the front shelter 14 has a plurality of nicks 141 disposed at the rear portions of the top surface and the bottom surface respectively (only the nicks 141 disposed at the rear portion of the top surface are shown in FIG. 2).

Figure 3:
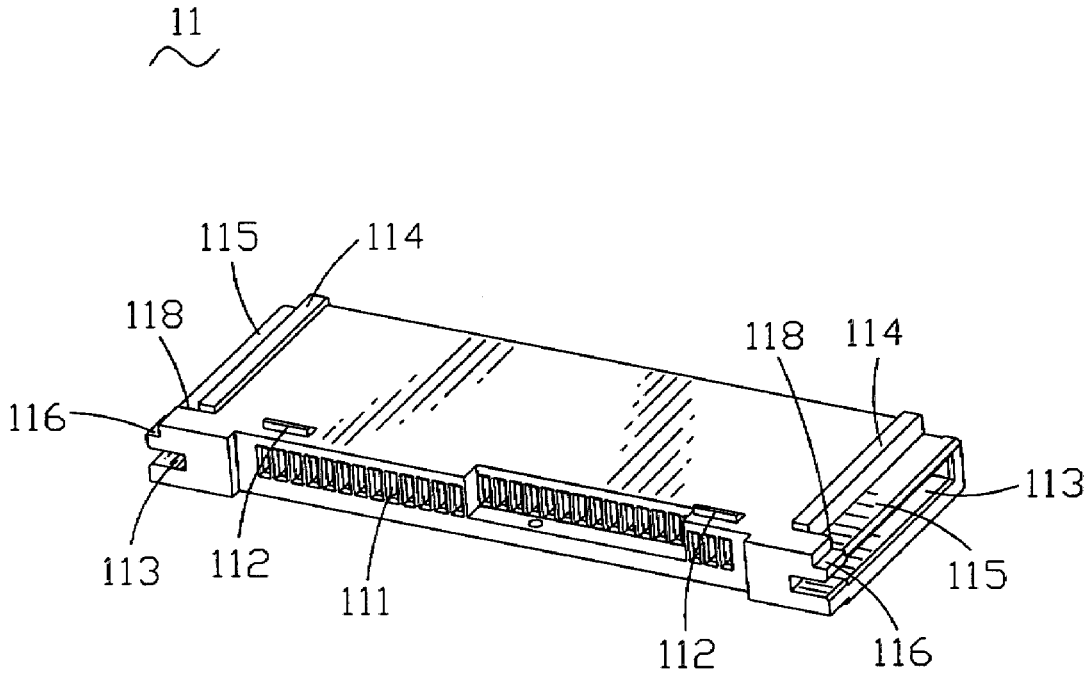
FIG. 3 is a perspective view of the insulative housing shown in FIG. 2 viewing from rear side.

As illustrated in FIGS. 2 and 3, the inner of the insulative housing 11 provides a plurality of contact channels 111 which extend from the front end to the rear end of the insulative housing 11 and receive the contacts 13 respectively. A plurality of protrusions 112 are protruded at the rear portions of the top surface and the bottom surface of the insulative housing 11 (only the protrusions protruded at the rear portion of the top surface are shown in FIGS. 2 and 3) respectively. A recess path 113 is defined at each lateral of the insulative housing 11. The lateral and the rear end of the recess path 113 communicate with the outside. A plurality of buckling lumps 114 are protruded on the top surface of the insulative housing 11 and located on the top portion of the recess path 113. Therefore, a hollow portion 115 is formed near to the recess path 113 and the buckling lumps 114. A ladder protrusion 116 is protruded at the rear end of the hollow portion 115. The ladder protrusion 116 has a front surface 118 formed at the front end of the ladder protrusion 116.

The upper shelter 15 has a front surface 152 and a rear portion 153 backwardly extending from the upper shelter 15.

The upper shelter 15 has a plurality of upper clasping slices 151 outwardly protruding from the laterals thereof.

The lower shelter 16 has a front surface 162 and a rear portion 163 backwardly extending from the front surface 162. The rear portion 163 is bent upward to form a rear surface 164. The two laterals of the lower shelter 16 have lower clasping slices 161 each protruding outwardly. Each lower clasping slice 161 has a locking arm 165 extending forwardly. The locking arm 165 has a free portion and a hook 166 extending forward from the free portion. The front portion of the upper shelter 15 and the lower shelter 16 form front surfaces of the electrical connector 100, the rear surface 164 of the lower shelter 16 forms the rear surface of the electrical connector 100.

Figure 4:
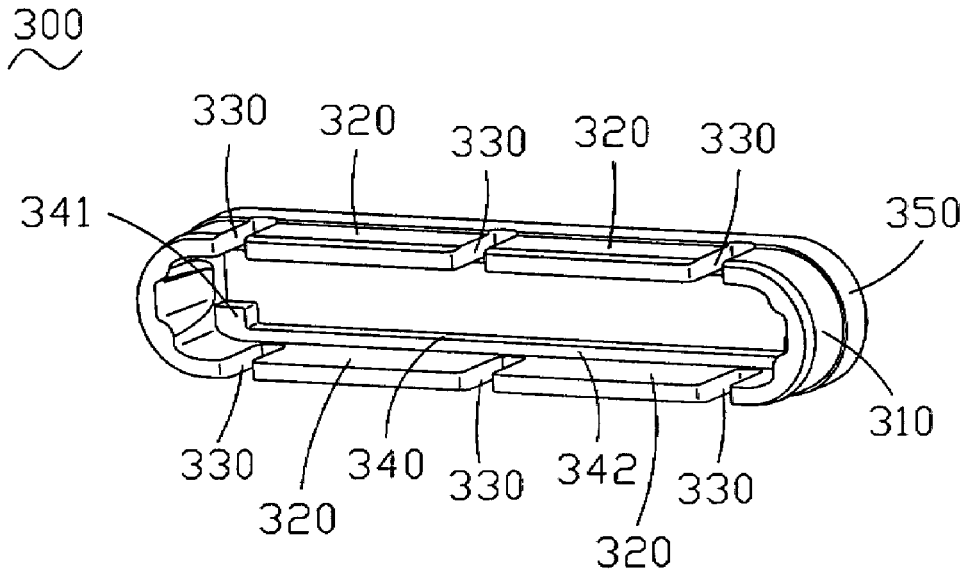
FIG. 4 is a perspective view of the inner cover of the cable connector assembly.

Refer to FIG. 4, the inner cover 300 has a flat and circular plate 350 extending backwardly. The plate 350 includes side plates 310 located at an arc portion of the inner cover 300 and middle plates 320 located at a middle portion of the inner cover 300. A plurality of grooves 330 are formed on the middle plates 320. The rear end of the grooves 330 communicate with outside. A raised board 340 is protruded inward and sited in the inner of the inner cover 300. The raised board 340 has a pair of blocking board 341 located near to the side plates 310 and a blocking bar 342 located near to the middle plates 320.

Figure 5:
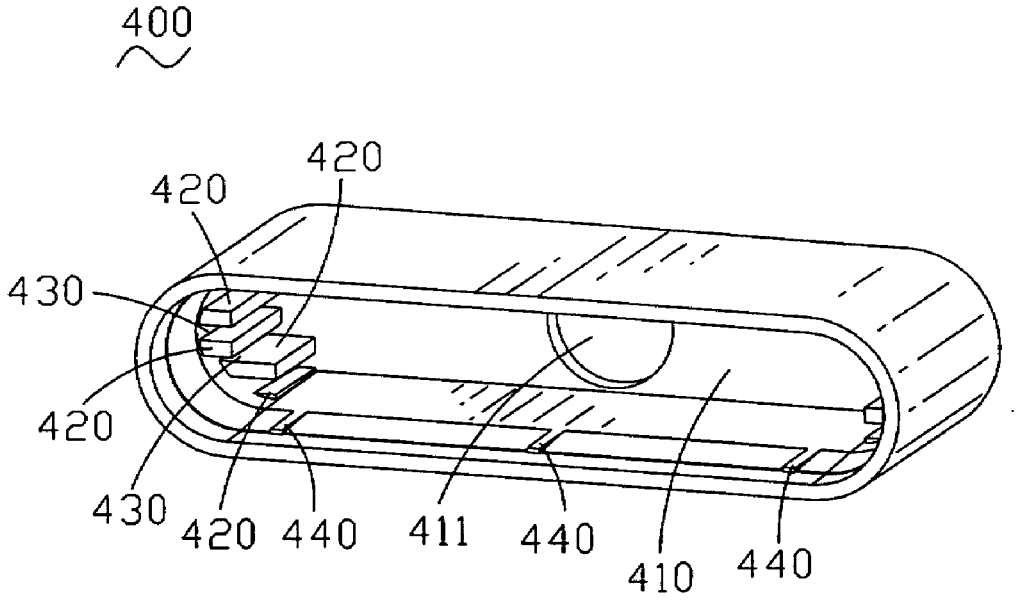
FIG. 5 is a perspective view of the outer cover of the cable connector assembly.
Figure 6:
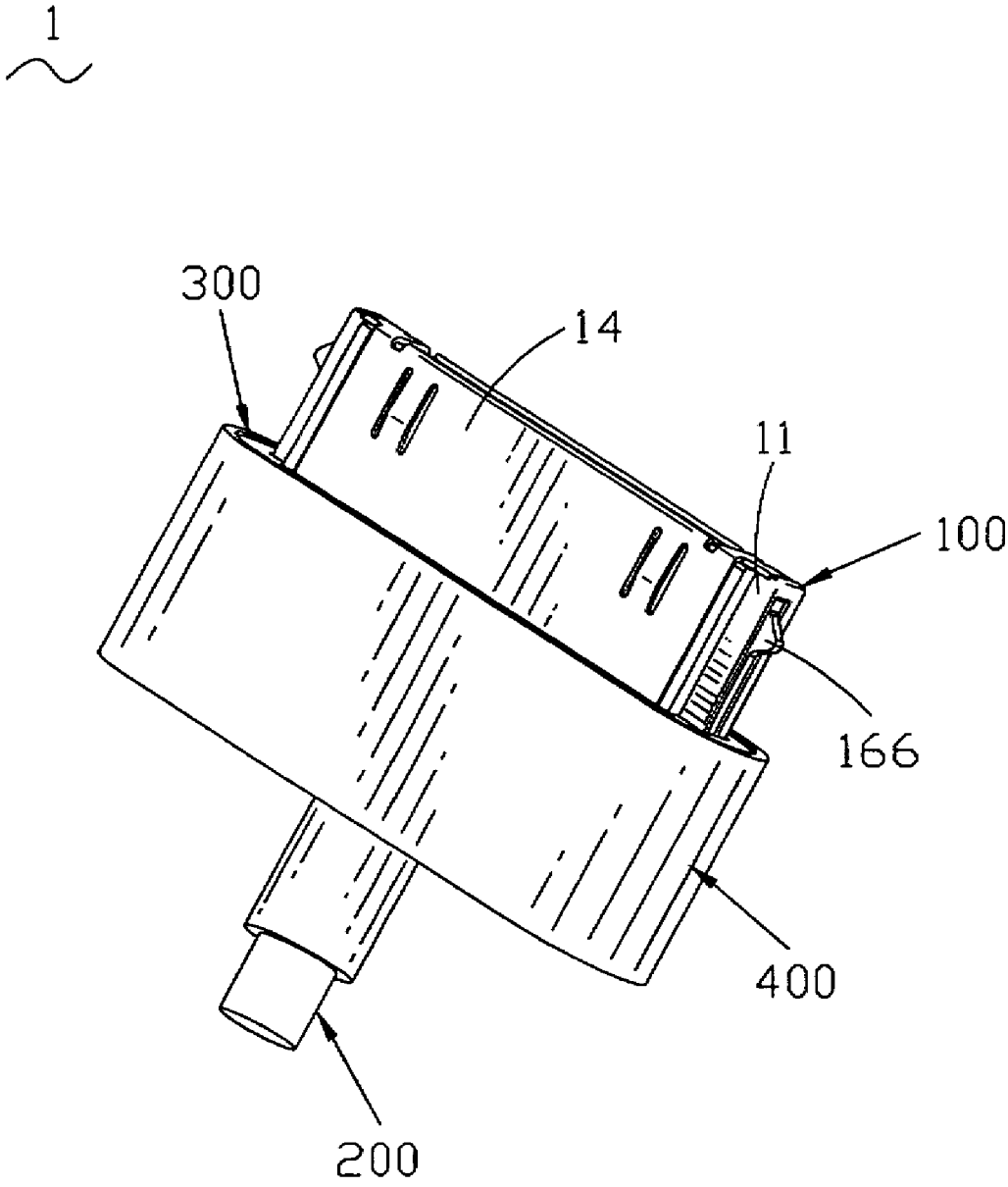
FIG. 6 is a perspective view of the cable connector assembly.

Refer to FIG. 5, the shape of the outer cover 400 is similar to the shape of the inner cover 300. The outer cover 400 has a rear surface 410, and an opening 411 is disposed on the rear surface 410. A plurality of bulges 420 are defined in the laterals of the inner of the outer cover 400 for forming a plurality of notches 430. A plurality of wedges 440 are formed on the inner surface of the outer cover 400.

Now, referring to FIGS. 1 to 6, when assembling the cable connector assembly 1 of the invention, first, the front shelter 14 covers the insulative housing 11 and the top surface of the front shelter 14 buckles the buckling lumps 114 therebetween. The protrusion 112 is received in the nick 141. The contacts 13 are inserted into the contact channels 111 of the insulative housing 11 and the printed circuit board 12 is connected to the contacts 13. The cable 200 is clipped by a clip 21 and soldered on the printed circuit board 12. Therefore, the cable 200 connects the contacts 13 electrically. And then, the upper shelter 15 and the lower shelter 16 cover the printed circuit board 12. The rear portion 163 of the lower shelter 16 encloses the rear portion 153 of the upper shelter 15 and the rear surface 164 of the lower shelter 16 leans against the rear end of the upper shelter 15. The locking arms 165 of the lower shelter 16 is inserted into the recess path 113 of the insulative housing 11 and the hook 166 is protruded from the recess path 113. At last, the cable 200 passes through the opening 411 of the rear surface 410. The outer cover 400 covers the electrical connector 100. The upper clasping slices 151 and the lower clasping slices 161 are inserted into the notches 430 of the outer cover 400. The inner portions of the side plates 310 mate with the hollow portion 115 of the insulative housing 11. The front surfaces of the blocking boards 341 lean against the front surface 118 of the ladder protrusion 116. The inner cover 300 is embedded in the outer cover 400 and the wedges 440 mate with the grooves 330 of the inner cover 300. Therefore, the cable connector assembly 1 is assembled securely and tightly.

Figure 7:
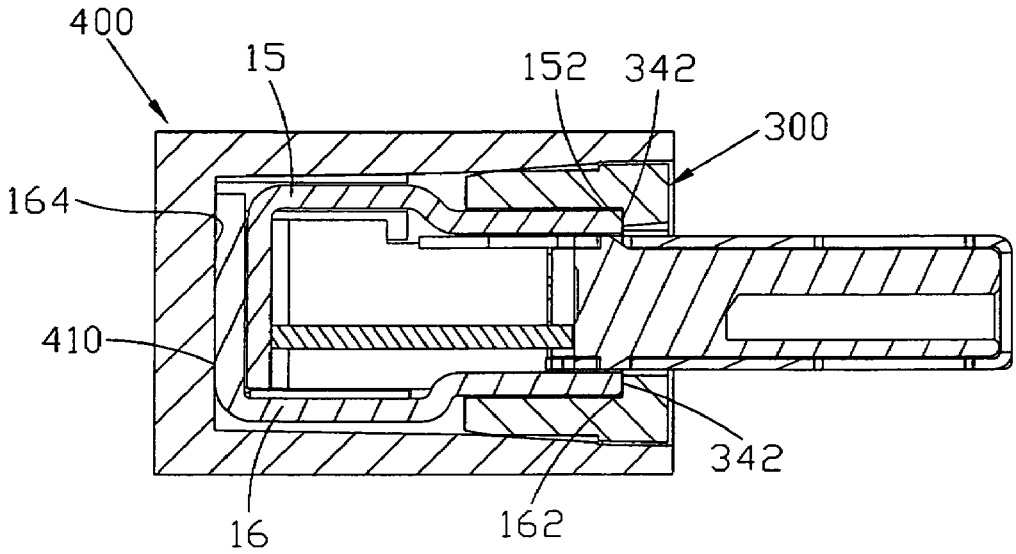
FIG. 7 is a cross-sectional view of the cable connector assembly.

Please refer to FIG. 7, after assembling the cable connector assembly 1, the top front surface of the blocking bar 342 leans against the front surface of the upper shelter 15, the bottom front surface of the blocking bar 342 leans against the front surface of the lower shelter 16 and the rear surface 410 of the outer cover 400 leans against the rear surface 164 of the lower shelter 16 for restraining the cable connector assembly 1 from moving horizontally.

Figure 8:
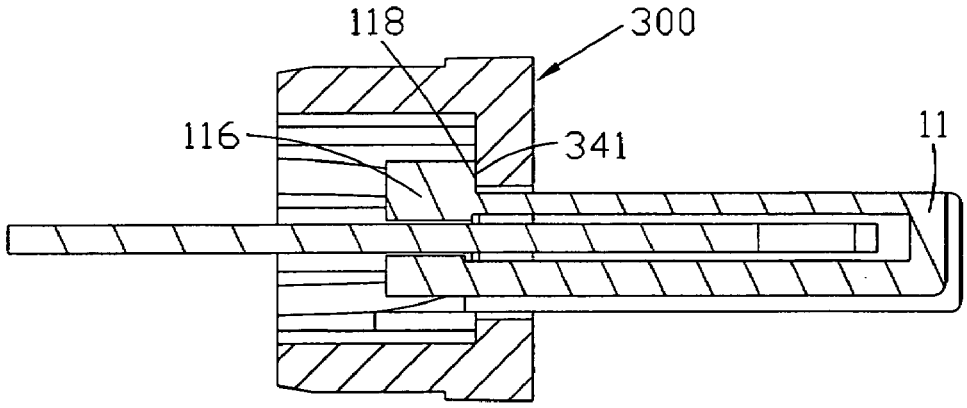
FIG. 8 is a cross-sectional view of the inner cover assembled with the electrical connector.

Refer to FIG. 8, the front surface 118 of the ladder protrusion 116 leans against the front surface of the blocking board 341 and the inner portions of the side plate 310 mate with the laterals of the insulative housing 11 for restraining the cable connector assembly 1 from swaying.

It can be seen that the inner cover 300 is mated with the outer cover 400 by the wedges 440 of the outer cover 400 and the grooves 330 of the inner cover 300. Therefore, the cable connector assembly 1 is assembled securely and tightly.

In a preferred embodiment, the side plates 310 and middle plates 320 of the inner cover 300 can also be constructed in a whole plate. A plurality of dents are formed on the whole plate for mating with the wedges 440 of the outer cover 400.

Although a preferred embodiment of the present invention has been described in detail hereinabove, it should be clearly understood that many variations and/or modifications of the basic inventive concepts herein taught which may appear to those skilled in the present art will fall within the spirit and scope of the present invention, as defined in the appended claims.

What is claimed is:

1. A cable connector assembly comprising:

an electrical connector including an insulative housing, a plurality of contacts received in the insulative housing and at least one shelter covering an outer surface of the insulative housing;

a cable electrically connecting to said contacts;

an outer cover covering said electrical connector and having a rear surface and an opening disposed on said rear surface, said cable passing through said outer cover; and an inner cover embedded in said outer cover and covering said electrical connector, said inner cover having a front surface; wherein said electrical connector has a plurality of front surfaces at a front portion thereof and a rear surface at a rear end thereof, said front surface of said inner cover leans against said front surfaces of said electrical connector and said rear surface of said outer cover leans against said rear surface of said electrical connector;

a plurality of wedges are formed on an inner surface of the outer cover;

a plurality of grooves corresponding to said wedges are formed on said inner cover; and said wedges are mated with said grooves respectively, wherein said at least one shelter of said electrical connector includes a front shelter, an upper shelter and an lower shelter which cover the front and rear portion of said insulative housing respectively, a front portion of said upper shelter and said lower shelter form said front surfaces of said electrical connector, the rear surface of said lower shelter forms said rear surface of said electrical connector; and wherein each lateral of said upper shelter has at least an upper clasping slices, each lateral of said lower shelter has at least a lower clasping slice, a plurality of bulges are defined in the laterals of the inner of said outer cover for forming a plurality of notches, said upper and lower clasping slices are inserted into the notches.

2. A cable connector assembly comprising:

an electrical connector including an insulative housing, a plurality of contacts received in the insulative housing and at least one shelter covering an outer surface of the insulative housing;

a cable electrically connecting to said contacts;

an outer cover covering said electrical connector and having a rear surface and an opening disposed on said rear surface, said cable passing through said outer cover; and an inner cover embedded in said outer cover and covering said electrical connector, said inner cover having a front surface; wherein said electrical connector has a plurality of front surfaces at a front portion thereof and a rear surface at a rear end thereof, said front surface of said inner cover leans against said front surfaces of said electrical connector and said rear surface of said outer cover leans against said rear surface of said electrical connector;

a plurality of wedges are formed on an inner surface of the outer cover;

a plurality of grooves corresponding to said wedges are formed on said inner cover; and said wedges are mated with said grooves respectively, wherein said at least one shelter of said electrical connector includes a front shelter, an upper shelter and an lower shelter which cover the front and rear portion of said insulative housing respectively, a front portion of said upper shelter and said lower shelter form said front surfaces of said electrical connector, the rear surface of said lower shelter forms said rear surface of said electrical connector; and wherein said lower shelter has a plurality of locking arms extending forwardly, said each locking arm has a free portion and a hook extending forwardly from said free portion, a recess path is defined on each lateral of said insulative housing for receiving said locking arms.

3. A cable connector assembly comprising:

an electrical connector including an insulative housing, a plurality of contacts received in the insulative housing and at least one shelter covering an outer surface of the insulative housing;

a cable electrically connecting to said contacts;

an outer cover covering said electrical connector and having a rear surface and an opening disposed on said rear surface, said cable passing through said outer cover; and an inner cover embedded in said outer cover and covering said electrical connector, said inner cover having a front surface; wherein said electrical connector has a plurality of front surfaces at a front portion thereof and a rear surface at a rear end thereof, said front surface of said inner cover leans against said front surfaces of said electrical connector and said rear surface of said outer cover leans against said rear surface of said electrical connector;

a plurality of wedges are formed on an inner surface of the outer cover;

a plurality of grooves corresponding to said wedges are formed on said inner cover; and said wedges are mated with said grooves respectively, wherein said at least one shelter of said electrical connector includes a front shelter, an upper shelter and an lower shelter which cover the front and rear portion of said insulative housing respectively, a front portion of said upper shelter and said lower shelter form said front surfaces of said electrical connector, the rear surface of said lower shelter forms said rear surface of said electrical connector; and wherein a plurality of buckling lumps are protruded on the top surface of said insulative housing, a hollow portion is formed near to a recess path and said buckling lumps, said front shelter covers said insulative housing and buckles said buckling lumps therebetween, the inner portion of said inner cover mates with said hollows portion.

4. The cable connector assembly as claimed in claim 1, wherein said cable connector further comprises a printed circuit board, said upper shelter and said lower shelter cover said printed circuit board, and said printed circuit board is connected to said cable and said contacts.

5. The cable connector assembly as claimed in claim 1, wherein at least one hollow portion is formed on the top surface of said insulative housing, a protrusion is protruded at the rear end of said hollow portion, and said protrusion has a front surface mated with the inner portion of said inner cover.

6. The cable connector assembly as claimed in claim 2, wherein said cable connector further comprises a printed circuit board, said upper shelter and said lower shelter cover said printed circuit board, and said printed circuit board is connected to said cable and said contacts.

7. The cable connector assembly as claimed in claim 2, wherein at least one hollow portion is formed on the top surface of said insulative housing, a protrusion is protruded at the rear end of said hollow portion, and said protrusion has a front surface mated with the inner portion of said inner cover.

8. The cable connector assembly as claimed in claim 3, wherein said cable connector further comprises a printed circuit board, said upper shelter and said lower shelter cover said printed circuit board, and said printed circuit board is connected to said cable and said contacts.

9. The cable connector assembly as claimed in claim 3, wherein at least one hollow portion is formed on the top surface of said insulative housing, a protrusion is protruded at the rear end of said hollow portion, and said protrusion has a front surface mated with the inner portion of said inner cover.

* * * * *